United States Patent [19]

Bourgie

[11] Patent Number: 5,071,364

[45] Date of Patent: Dec. 10, 1991

[54] AUTOMATIC INTERCONNECTION ASSEMBLY, NOTABLY FOR ELECTRICAL CONNECTION TO A PACK COMPRISING A PLURALITY OF MISSILE-LAUNCHER TUBES

[75] Inventor: Paul Bourgie, St Arnoult en Yvelines, France

[73] Assignee: Thomson-CSF, Puteaux, France

[21] Appl. No.: 613,296

[22] Filed: Nov. 15, 1990

[30] Foreign Application Priority Data

Nov. 28, 1989 [FR] France ..... 89-15617

[51] Int. Cl.[5] ..... H01R 13/62

[52] U.S. Cl. ..... 439/296; 439/310; 439/248

[58] Field of Search ..... 439/152, 153, 158, 246, 439/247, 248, 310, 296

[56] References Cited

U.S. PATENT DOCUMENTS 3,089,925 5/1963 Landstrom et al. ..... 439/296 X
3,156,512 11/1964 Peterson et al. ..... 439/310 X
4,156,551 5/1979 Nagase et al. .
4,264,115 4/1981 Chow ..... 439/296 X
4,508,404 4/1985 Frawley .
4,580,862 4/1986 Johnson ..... 439/248

FOREIGN PATENT DOCUMENTS 0174210 3/1986 European Pat. Off. .
0604063 4/1978 U.S.S.R. .

*Primary Examiner*—Neil Abrams
*Assistant Examiner*—Khiem Nguyen
*Attorney, Agent, or Firm*—Roland Plotter

[57] ABSTRACT

An automatic interconnection assembly with: on one side, a first connector element, and on the opposite side, a telescopic assembly having at its free end a second connector element. This assembly is moved by a control actuator, the extension of which makes the second connector element approach and then plug into the first connector element. Means axially and transversally align the two connector elements and orients them angularly with respect to each other, prior to the plug-in operation, as they approach each other.

3 Claims, 2 Drawing Sheets

AUTOMATIC INTERCONNECTION ASSEMBLY, NOTABLY FOR ELECTRICAL CONNECTION TO A PACK COMPRISING A PLURALITY OF MISSILE-LAUNCHER TUBES

BACKGROUND OF THE INVENTION

1. Field of the Invention

The present invention concerns an automatic interconnection assembly designed to provide for electrical connection to a pack by the plugging in of a connector.

It can be applied very particularly to the connection, from a weapon carriage and by means of a single common connector, of a firing control system to a plurality of missile-launcher tubes combined in one and the same modular block, known in the field as a "pack".

2. Description of the Prior Art

FIG. 1 gives a schematic view of this configuration. In this figure, the reference 1 generally designates a missile-launcher battery mounted, for example, on an armored vehicle 2, on a ship's superstructure, etc.

This missile-launcher battery 1 includes, in addition to the firing control system with its different detection and tracking instruments, an azimuthally mobile barrel 3, on which there are mounted one or more packs 4 capable of being oriented in relative bearing.

Each of the packs 4 constitutes a pack formed by a plurality of missile-launcher tubes 5 assembled and fixedly joined mechanically, for example by means of a frame 6 and a supporting part 7.

The pack can be easily installed and removed for replacement after the missiles have been fired.

Apart from the mounting and mechanical locking of the pack on to the carriage, provision should be made for an electrical connection to each of the missiles, notably for the resetting of the firing and initiation parameters.

Up till now, this electrical connection was made by hand, and individually, by an operator who connected a connector plug-in element, mounted at the end of a cable, on the homologous connector of the corresponding missile-launcher tube, in doing so for each of the tubes of the pack.

From the electrical viewpoint alone, such a procedure provides for an interconnection that is quite satisfactory.

However, it implies that an operator has to come out of the armored vehicle to perform the electrical connection operation, while the mechanical mounting of the pack on the carriage can be entirely remote-controlled, the locking of the pack being done automatically as soon as it is installed and positioned accurately on the carriage.

In certain circumstances, this kind of action may be difficult or dangerous.

This is so notably in an environment of nuclear, bacteriological or chemical warfare, or under very low temperatures (the operator being equipped with very thick gloves) or when the firing station is not stable (this is typical in a ship) etc.

Moreover, in the event of misfiring, the operator must disconnect the supply corresponding to the faulty missile before any other operation. Action therefore has to be taken in the vicinity of the faulty missile with an additional risk of error arising out of the fact that the operator, in mistaking the different electrical supplies, may very well disconnect a missile other than the faulty one.

SUMMARY OF THE INVENTION

This is why it has appeared to be desirable to have an interconnection system that is both automatic (to avoid the need for action by an operator) and unique for all the missiles of the pack (in order to circumvent the risks related to action on the cables of the different missile-launcher tubes).

Thus, it is one of the aims of the invention to propose an automatic assembly such as this.

Furthermore, in view of the inevitable excess cost introduced by an automatic assembly performing functions that were previously performed in a manual action, it has appeared to be highly desirable to set up this automatic assembly with easily available, low-cost standard type main elements.

This is applicable typically to the connector elements and control actuators which are usually the costliest parts to be made if they have to be specifically designed for the application considered further above.

However, for it to be possible to use these standard parts (for example connector elements such as those used for the interconnection of circuits installed in laboratory shelves) they must be used in an assembly with a configuration adapted to meeting the different constraints for which these standard parts are not originally planned.

This is the case notably of the shielding against external attack, and especially of the compensation for axial and transversal misalignment, as well as the defects of angular orientation, between the elements to be interconnected.

Thus, it is another aim of the invention to propose a structure enabling these standard parts to be adapted to the constraints proper to the context of the electrical connection of the missile packs.

It is yet another aim of the invention to propose an interconnection assembly making it possible to meet the constraint of a "positive mounting", that is, once the control element (generally an actuator) has been stopped, the assembly should remain mechanically blocked in a connected position despite the vibrations, external constraints etc. which may be applied to it, thus giving a reliable interconnection with its being necessary to keep the actuator in the supplied state.

To this effect, according to the invention, the automatic interconnection assembly includes: This automatic interconnection assembly includes:

on one side, a first connector element, on the opposite side, a telescopic assembly including, at its free end, a second connector element, this assembly being moved by a control actuator, the stretching of which makes the second connector element approach the first connector element and then plugs it into this first connector element;

alignment means to axially and transversally align the two connector elements and to orient them angularly with respect to each other, when they are approaching each other relatively and prior to the start of the plug-in operation, and means for limiting the travel of the actuator, to detect the total plugging together of the connector elements and to then interrupt the stretching of the actuator.

In a preferred embodiment, the above-mentioned telescopic assembly includes:

an intermediate tube, housed in a fixed external tube, fixedly joined to the carriage and movable in axial translation in this external tube, this intermediate tube having a first supporting surface at its end pointed towards the pack., said first supporting surface being designed to cooperate with a homologous second supporting surface fixedly joined to the first connector element, said alignment means being formed on these supporting surfaces, an internal tube, housed in the intermediate tube and movable in translation in this tube, this internal tub bearing the second connector element at its end pointed towards the pack, and being connected to the rod of the control actuator by its opposite end, and elastic means for linking the internal tube to the intermediate tube, these means enabling the transmission to the intermediate tube, during the approaching stage, of the shift communicated to the internal tube by the actuator and being gradually compressed once said supporting surfaces come into contact, the stretching of the actuator then causing only a shift of the internal tube alone.

According to a certain number of advantageous characteristics:

the first connector element is mounted on a supporting part comprising said second supporting surface, this supporting part being mounted so as to be floating on the body of the pack;

in this latter case, said supporting part is mounted so as to be floating on the body of the pack by means of elastic linking means permanently pushing the two supporting faces against each other after they have come into contact; and when the actuator is an electrical actuator, the means for limiting the travel of the actuator include means to detect the excess current resulting from the stopping of the actuator when the two connector elements are completely plugged together, and to interrupt the supply of the actuator upon the detection of this excess current.

BRIEF DESCRIPTION OF THE DRAWINGS

An exemplary embodiment of the invention shall be described with reference to the appended drawings.

DESCRIPTION OF THE PREFERRED EMBODIMENTS

Figure 1:
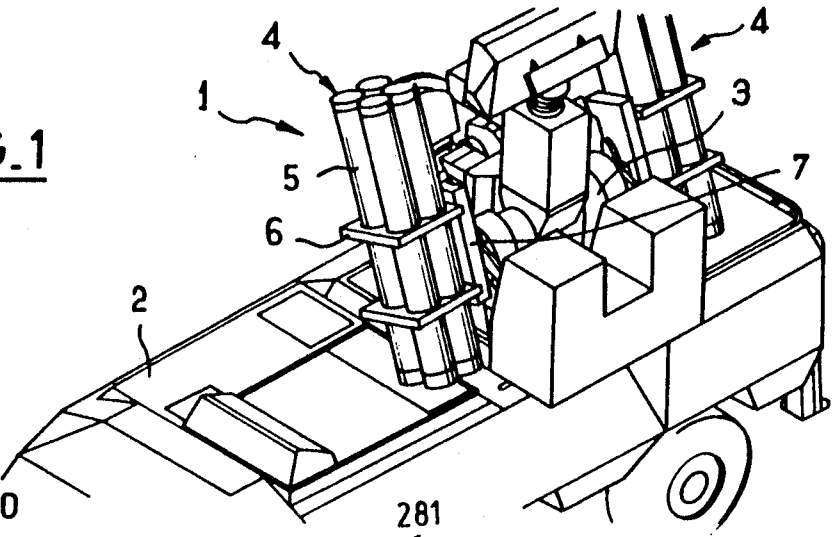
FIG. 1, referred to above, is an overall view showing the arrangement of the packs of missile-launcher tubes on the carriage that supports them.
Figure 2:
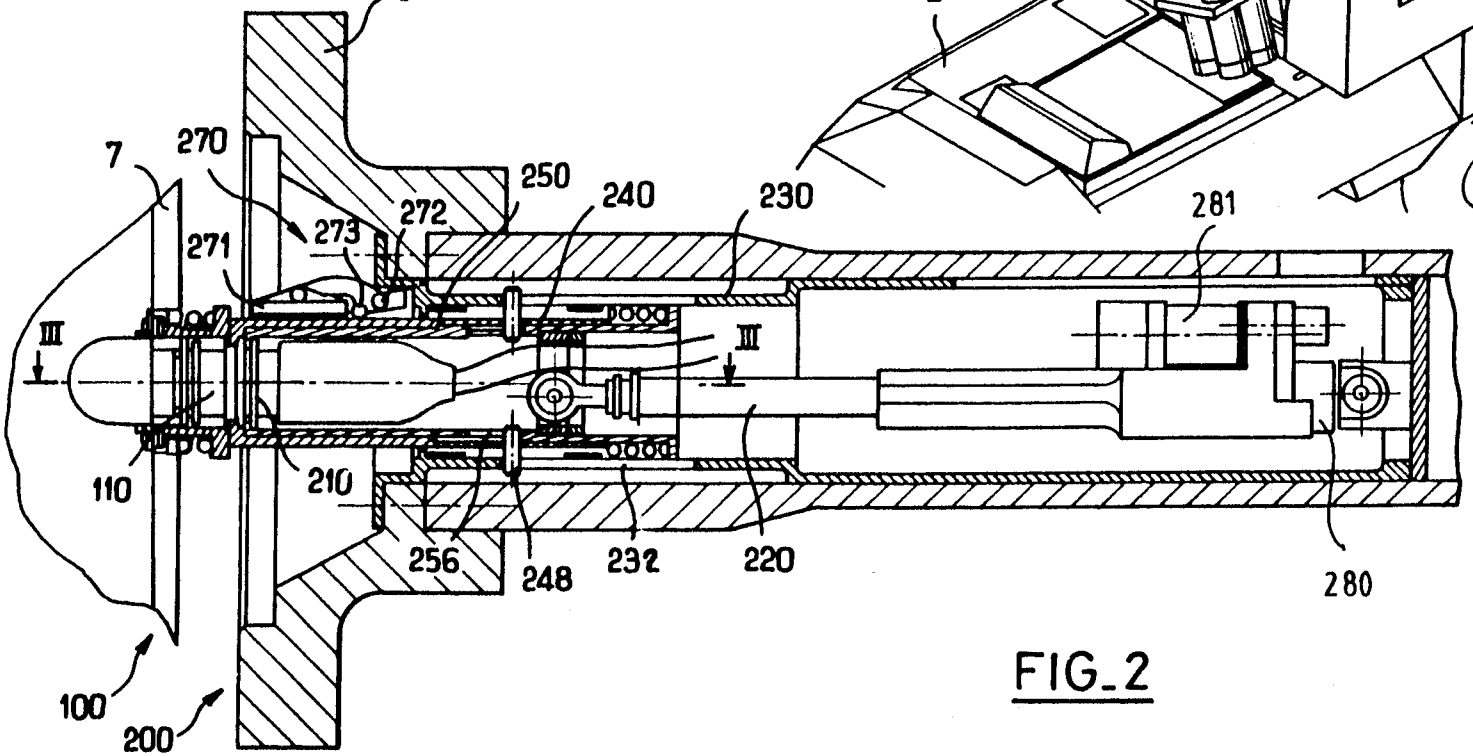
FIG. 2 is a vertical sectional view of the interconnection assembly of the invention in stretched position, i.e. in a position corresponding to the total plugging in of the connector.
Figure 3:
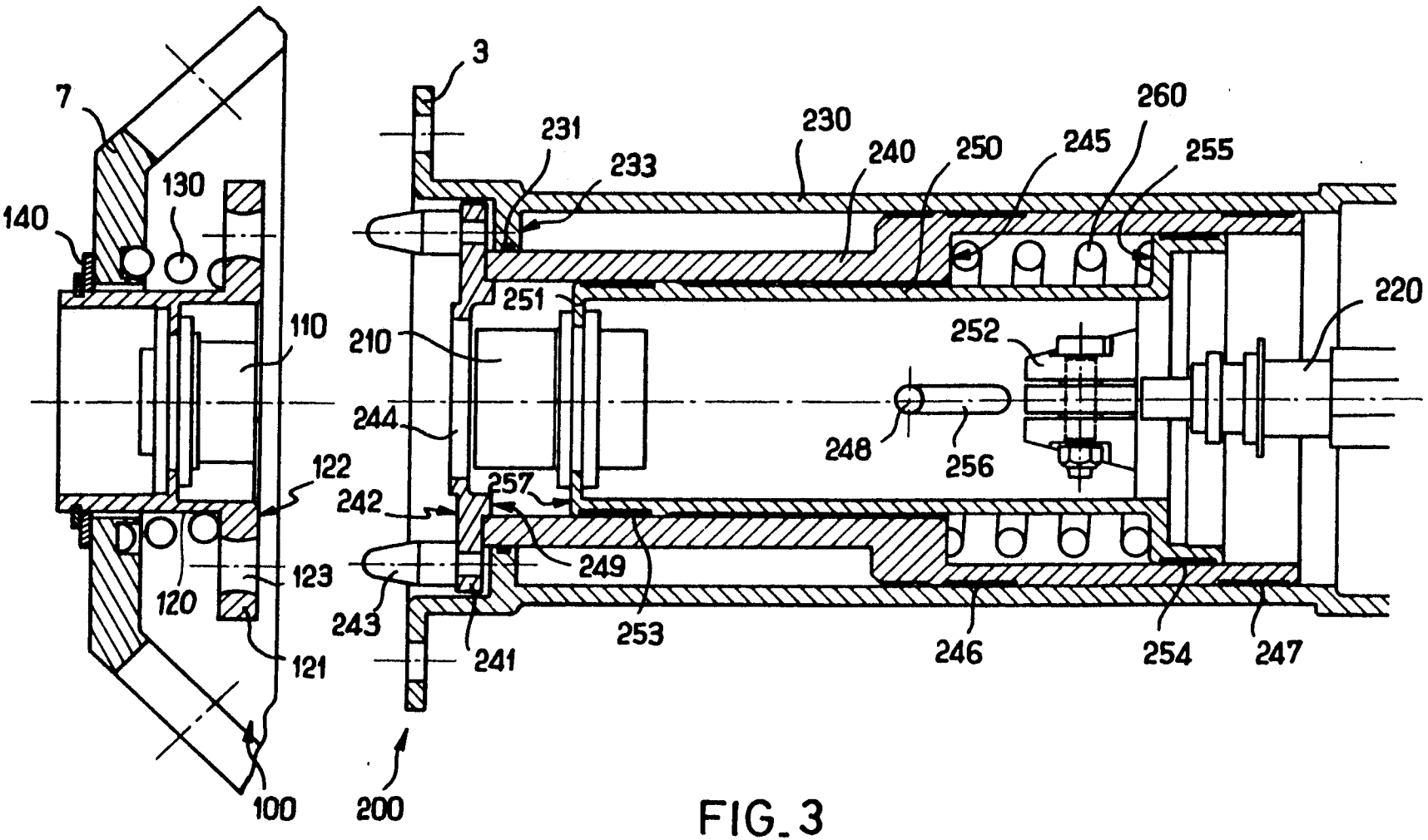
FIG. 3 is a plane view, along III—III of FIG. 2, of this same interconnection assembly in retracted position, i.e. before the sequence of connection of the two parts of the connector has begun.

In FIGS. 2 and 3, the reference 100 represents the different elements located on the pack side, and 200 represents those that are located on the carriage side.

The elements 100 essentially include a first connector element 110, which is unique for the entire pack, the connections of which reach the different tubes of this pack. This connector element 110 is mounted on a part 120 mounted so as to be "floating" on the body 7 of the pack, i.e. it is hinged so as to have degrees of freedom in pivoting about transversal axes, one degree of freedom in translation in an axial direction and two restricted degrees of freedom in translation in the vertical and horizontal directions. This floating assembly enables the taking up, in the way that shall be described further below, of any faults in alignment between the two connector elements, due to possible tolerances in the dimensioning and positioning of the pack on the carriage.

This floating assembly is set up by means of a conical spring 130 playing the role of a pivot, the part 120 being mounted with a clearance in the body 7 that is sufficient to absorb possible misalignments. A stop ring 140 keeps the part 120 in position on the body 7.

This part 120 has a end plate 121 on the side pointed towards the carriage. This end plate 121 defines a supporting surface 122 (which is plane in the illustrated example) provided with centering holes 123. The connector element 110 is mounted on the part 120 in such a way that its front portion does not project beyond the plane of the reference surface 122.

On the carriage side, a connector element 210, homologous to the connector element 110 facing it, is mounted on a telescopic assembly housed in a fixed tube 230 fixedly joined to the carriage 3.

This telescopic assembly is formed by an intermediate tube 240 sliding in the fixed tube 230, and an internal tube 250 sliding in the intermediate tube 240.

The second connector element 210 is mounted at the end 251 of the sliding tube 250, the opposite end 252 of which is connected to the rod of a actuator 220 which drives it in axial translation.

The internal tube 250 is furthermore provided with sliding and clearance-correcting surfaces 253, 254 designed to help it to slide within the tube 240.

In the front part, the tube 240 has a end plate 241. The outwardly directed face of this end plate 241 has a supporting surface 232, which is homologous to the supporting surface 122 of the part 120, and bears centering pins 243 homologous to the centering apertures 123 of the part 120. An aperture 244 in the end plate 241 will enable the passage, during the stretching of the actuator, of the connector element 210 which will project beyond the surface 242 (position illustrated in FIG. 2).

Like the tube 250, the intermediate tube 240 is provided with guiding and sliding surfaces 246, 247 making it easy for it to slide inside the fixed .tube 230.

The tubes 240 and 250 are elastically linked by a spring 260 that pushes the two parts away from each other by being interposed between the respective shoulders 245, 255 of these two parts.

Besides, to restrict the rotation of the different parts in their translational motion, there is provision for transversal fingers 248 (FIG. 2) fixedly joined to the intermediate tube 240, which will make it possible to restrict the shifting of this intermediate tube 240, firstly with respect to the fixed tube 230 and, secondly, with respect to the internal tube 250.

Finally, to shield the connector elements against external attack, there is provision of blocking means, for example an assembly 270 comprising a flap valve 271 hinged on the body 3 of the carriage by a shaft 272 and including a opening-control roller 273 which prompts the opening of the flap during the stretching of the intermediate tube 250.

The connector element 110 of the pack is also provided with an appropriate flap (not shown) the withdrawal of which may be obtained, for example, by pressure on the pins 243 during the stretching stage of the intermediate tube 250.

We shall now describe the working of this interconnection system.

In the initial position, which is the one shown in FIG. 3, the two connector elements 110 and 210 are dissociated and concealed by their respective blocking elements (not visible in FIG. 3).

In this state, no signal can go through towards the missiles, and security is therefore totally ensured. In particular, in case of misfiring, the immediate return to this inactivated state will immediately bar any dispatching of signals to any one of the missiles of the pack.

Furthermore, since the blocking means are closed, the connector elements are shielded separately from external attack (rain, sand, mud etc.).

When the command for the plugging in of the connector (which may be brought about automatically, for example as soon as the pack has been mechanically locked into position on the carriage), the following operations succeed one another:

the actuator starts stretching, and pushes back the internal tube 250 and the intermediate tube 240 together (by means of the spring 260 which then transmits the force exerted on the internal tube 250, and hence the shifting of this tube, to the intermediate tube 240). The intermediate tube 240 starts projecting out of the fixed tube 230, and comes to rest on the roller 273. This has the effect of making the flap valve 271 tilt over. When this flap valve has pivoted by 90°, the roller 273 rolls along the generatrix of the intermediate tube 240 (as can be seen in FIG. 2) and will therefore not counter the subsequent motion of the different parts of the system.

One of the pins 243, coming into contact with the system for opening the flap valve concealing the connector element 110 of the pack, triggers the withdrawal of this flap valve. The two connector elements are then both released, facing each other and at a distance from each other.

The actuator continues its travel, the end plate 241 on the carriage side meets the end plate 121 on the pack side; the respective cooperating surfaces 242 and 122 get applied to each other and the centering is achieved by the penetration of the pins 242 into the centering apertures 123. These pins also make it possible to correct the error of angular orientation of the two connectors, so that these two connectors are then exactly aligned (both axially and transversally) and oriented angularly to enable them to be accurately plugged together.

The intermediate tube 240 abuts the internal shoulder 233 of the fixed tube 230, thus stopping the travel of the intermediate tube 240; the pressure exerted by the conical spring 130 keeps the two end plates 121 and 241 applied against each other.

With the intermediate tube 240 having reached the limit of travel, the continuance of the stretching of the actuator then makes the connector element 210 gradually project out of the aperture 244 while, at the same time, compressing the spring 260. The end of travel or limit stop occurs when the end face 257 of the tube 250 abuts the internal shoulder 249 of the intermediate tube 240 corresponding to the position illustrated in FIG. 2.

The connector elements are then entirely plugged together. It is possible to make provision, in the supply circuit of the electrical actuator 220, for an excess current detector 280 triggering a solenoid valve that cuts off the supply to the actuator (the excess current results from the appearance of the abutment point corresponding to the limit stop 281).

It is seen that, in the final position, the interconnection is achieved and maintained even if the actuator is no longer supplied. This makes it possible to withstand any forces or vibrations which may cause the two connector elements to come unfixed.

The stopping of the retracted actuator in the limit stop position is provided by a contactor built into the actuator, the mechanical limitation of the travel being provided by the finger 248.

What is claimed is:

1. An automatic interconnection assembly, designed to provide for the electrical connection of a frame to a pack supported on a body by the plugging in of a connector, comprising:

a first connector element supported on said pack and fixedly joined to a first supporting surface;

a second connector element capable of being made to approach said first element and then being plugged into it;

an external tube fixedly joined to said frame;

a control actuator positioned within said external tube and having a movable rod;

an intermediate tube, housed in a fixed external tube and movable in axial translation in it, said intermediate tube having, at an end pointed towards said pack, a second supporting surface homologous with said first supporting surface;

an internal tube, housed in the intermediate tube and movable in translation, said internal tube having a first end pointed towards said pack and bearing said second connector element and a second end connected to said rod of the control actuator;

elastic means of linkage between said internal tube and said intermediate tube to enable the transmission to the intermediate tube, during the approach movement, of the shift communicated to the internal tube by the actuator until said first and second supporting surfaces come into contact, the stretching of the actuator then causing only a shift of the internal tube alone;

alignment means formed on said supporting surfaces to axially and transversally align the two connector elements and to orient them angularly with respect to each other, when they are approaching each other, prior to the start of the plug-in operation;

means for limiting the travel of the actuator, to detect the total plugging together of the connector elements and to then interrupt the stretching of the actuator; and a flap valve hinged on said body by a shaft and including an opening-control roller which prompts the opening of said flap during the stretching of said intermediate tube.

2. The automatic interconnection assembly of claim 1 wherein, the actuator being an electrical actuator, said means for limiting the travel of the actuator include means to detect the excess current resulting from the stopping of the actuator when the two connector elements are completely plugged together, and to cut off the supply to the electrical actuator upon the detection of this excess current.

3. The automatic interconnection assembly of claim 1, further including an electrical limit stop to interrupt the supply to the actuator when it has reached its furthest retracted position.

* * * * *